United States Patent [19]

Griffin

[11] 4,163,301

[45] Aug. 7, 1979

[54] TUNNEL OR LIKE WALL CLEANING MACHINE

[76] Inventor: Kenneth E. Griffin, 6304 204th SW., Lynnwood, Wash. 98036

[21] Appl. No.: 923,577

[22] Filed: Jul. 11, 1978

[51] Int. Cl.[2] ..... A47L 1/38

[52] U.S. Cl. ..... 15/50 R; 51/180

[58] Field of Search ..... 15/49, 50, 51, 52, 53, 15/98, 319, 340; 51/180

[56] References Cited

U.S. PATENT DOCUMENTS

| | | | |
|---|---|---|---|
| 1,823,222 | 9/1931 | Whitsitt | 15/53 R |
| 1,901,647 | 3/1933 | Howald et al. | 15/50 R X |
| 2,124,705 | 7/1938 | Locklin | 15/49 R |
| 2,253,609 | 8/1941 | Byron et al. | 15/53 A |
| 2,636,198 | 4/1953 | Wilson | 15/53 A |
| 2,787,096 | 4/1957 | Riddels et al. | 51/180 |
| 2,804,635 | 9/1957 | Wilson | 15/53 A |
| 2,865,034 | 12/1958 | Petite | 15/53 A |
| 2,876,472 | 3/1959 | Rousseau | 15/53 A |
| 2,950,492 | 8/1960 | Liekweg | 15/53 A |
| 3,099,852 | 8/1963 | Grant | 15/50 R |
| 3,196,472 | 7/1965 | Ventrella | 15/53 R |
| 3,296,748 | 1/1967 | Talley | 51/180 |
| 3,457,574 | 7/1969 | Hirt | 15/21 E |
| 3,473,180 | 10/1969 | Lenhart | 15/50 R |
| 3,543,319 | 12/1970 | Posner | 15/53 A |
| 3,641,618 | 2/1972 | Rainey et al. | 15/21 E X |
| 3,643,274 | 2/1972 | Hodges | 15/56 |
| 3,748,680 | 7/1973 | Griffin | 15/50 C |
| 3,806,979 | 4/1974 | Bonami | 15/21 R |
| 3,830,430 | 8/1974 | Hartunian | 15/50 C X |

*Primary Examiner*—Edward L. Roberts

*Attorney, Agent, or Firm*—Graybeal & Uhlir

[57] ABSTRACT

Cleaning apparatus usable to clean those portions of a tunnel wall or the like which are located behind railing means typically placed along a walkway beside the wall, such as in a freeway tunnel. A guidance carriage engages the railing and is movable therealong. A support carriage, which can be moved along the walkway, carries a plurality of motor driven circular brushes for cleaning these wall portions. Between the guidance carriage and the support carriage are located linear fluid motors urging the carriages in laterally opposite directions, the support carriage in turn urging the brushes into contact with the wall, and the guidance carriage being urged by said motors against the railing which provides horizontal support for the guidance carriage. The railing also provides vertical support for the guidance carriage while the walkway provides vertical support for the support carriage. The guidance carriage and the support carriage may be removably engageable with each other to enable the cleaning apparatus to be easily positioned on and removed from the walkway.

7 Claims, 3 Drawing Figures

TUNNEL OR LIKE WALL CLEANING MACHINE

BACKGROUND OF THE INVENTION

1. Field of the Invention

This invention relates to tunnel and like wall cleaning apparatus, and more particularly to readily portable wall cleaning apparatus for cleaning those portions of a tunnel wall or the like located behind railing means placed along the walkway typically provided along the tunnel wall.

2. Description of the Prior Art

In a tunnel, such as an automobile freeway tunnel, it is desirable to periodically clean the walls to remove accumulations of dirt, automobile exhaust, etc.

My U.S. Pat. No. 3,748,680 discloses a self-propelled tunnel cleaning apparatus mounted on a truck which moves along the roadway in the tunnel. The device utilizes a cylindrical brush which may be selectively positioned against the tunnel wall.

Lenhart U.S. Pat. No. 3,473,180, discloses a self-propelled wall scrubbing and buffing machine having a staggered array of flat, circular brushes. The device is guided by the operator who manually steers the device.

Rainey et al U.S. Pat. No. 3,641,618; and Bonami U.S. Pat. No. 3,806,979, disclose various devices operable along an overhead rail system, and which are suspended from the rail being cleaned.

Hirt U.S. Pat. No. 3,457,574, discloses a cleaning device for marker posts on highways or the like having a pair of counter-rotating cylindrical brushes. The device is trailer mounted and is towed along the roadway by a vehicle which supplies it with power through the vehicle's power take-off shaft.

Hodges U.S. Pat. No. 3,643,274, discloses a cut mounted trough cleaning apparatus which utilizes guidance wheels to cant a cylindrical brush within the trough in order to more effectively clean the trough. The cart is towed by a vehicle which supplies power to the cleaning apparatus.

Hartunian U.S. Pat. No. 3,830,430, discloses a self-propelled cleaning device for cleaning the inside of a chamber such as a truck body. The device utilizes high pressure sprays for cleaning and opposing guidance wheels to orient the device within the chamber.

Grant U.S. Pat. No. 3,099,852; and Ventrella U.S. Pat. No. 3,196,427, disclose self-propelled cleaning devices utilizing a cleaning brush mounted on the end of a boom.

Wilson U.S. Pat. No. 2,636,198, and Rousseau U.S. Pat. No. 2,876,472, disclose portable cleaning machines for vehicles utilizing a vertically oriented cylindrical brush and adapted to be transported by a forklift type vehicle.

Posner U.S. Pat. No. 3,543,319, and Petite U.S. Pat. No. 3,865,034, disclose self-propelled devices having a U-shaped frame carrying cylindrical brushes on two sides of the frame for washing trailers and railroad cars, respectively.

Wilson U.S. Pat. No. 2,804,635 discloses a manually propelled, cart mounted vehicle washing device utilizing a vertically oriented cylindrical brush. Power and water are supplied to the cart from an external source through conduits.

Leikweg U.S. Pat. No. 2,950,492, discloses a truck mounted vehicle washing machine utilizing a vertically oriented cylindrical brush.

Whitsitt U.S. Pat. No. 1,823,222, and Byron et al U.S. Pat. No. 2,253,609, disclose railroad car cleaning devices utilizing a reciprocating rack of rectangular brushes and a vertically oriented cylindrical brush, respectively.

SUMMARY OF THE INVENTION

In basic form, the present invention includes a guidance carriage adapted to engage the guard or hand railing typically found alongside a walkway alongside a tunnel to be cleaned, wherein the guidance carriage is movable longitudinally along the railing. A support carriage carries a plurality of motor driven, rotatable surface cleaning devices. Biasing components, connected between the guidance carriage and the support carriage, urge said carriages in opposite directions, the support carriage in turn urging the surface cleaning devices into contact with the tunnel wall and the guidance carriage being urged by the biasing devices against the railing which provides horizontal support for the guidance carriage.

Such a tunnel or like wall cleaning apparatus achieves a basic feature and advantage of the present invention, in the sense of being adapted to clean those portions of a wall laterally behind the railing typically found along a tunnel walkway.

Other aspects of the present invention involve the surface cleaning devices involving a plurality of generally flat, circular brushes, each of which is canted about a generally vertical axis passing through one of its diameters to ensure contact of its leading or trailing edge portion despite the wall's curvature, vertically considered.

Other aspects of the tunnel wall cleaning apparatus of the present invention involve wall contacting wheel means on the support carriage. Such a construction helps to achieve one of the objects of the present invention, that of enabling the cleaning device to ride over an obstacle or obstruction on the wall.

A further aspect of the present invention is the adaptation of the wall cleaning apparatus to be towed by a vehicle riding on the roadbed within the tunnel, inboardly of the walkway. The towing vehicle typically also supplies the tunnel cleaning apparatus with power, compressed air, cleaning solution and rinsing solution. This helps achieve another object of the present invention, that of keeping the weight of the cleaning apparatus at a minimum so that it may be readily and manually installed behind and removed from the railing.

Other aspects of the present invention include construction of the cleaning apparatus so that the guidance carriage and the support carriage are removably engageable with each other. Such a construction also helps to achieve the foregoing object, since by so making the guidance carriage and the support carriage separable, the machine may be conveniently dismantled into two basic components which may be then inserted and removed by hand from behind the railing along the wall, without the aid of mechanical lifting devices.

Another object of the present invention is to provide a cleaning apparatus adapted to clean tunnel or like walls of either curved or flat configuration.

These and other objects, features, advantages and characteristics of the cleaning apparatus of the present invention will be apparent from the following more detailed description of a typical embodiment thereof.

DESCRIPTION OF THE PREFERRED EMBODIMENT

Figure 1:
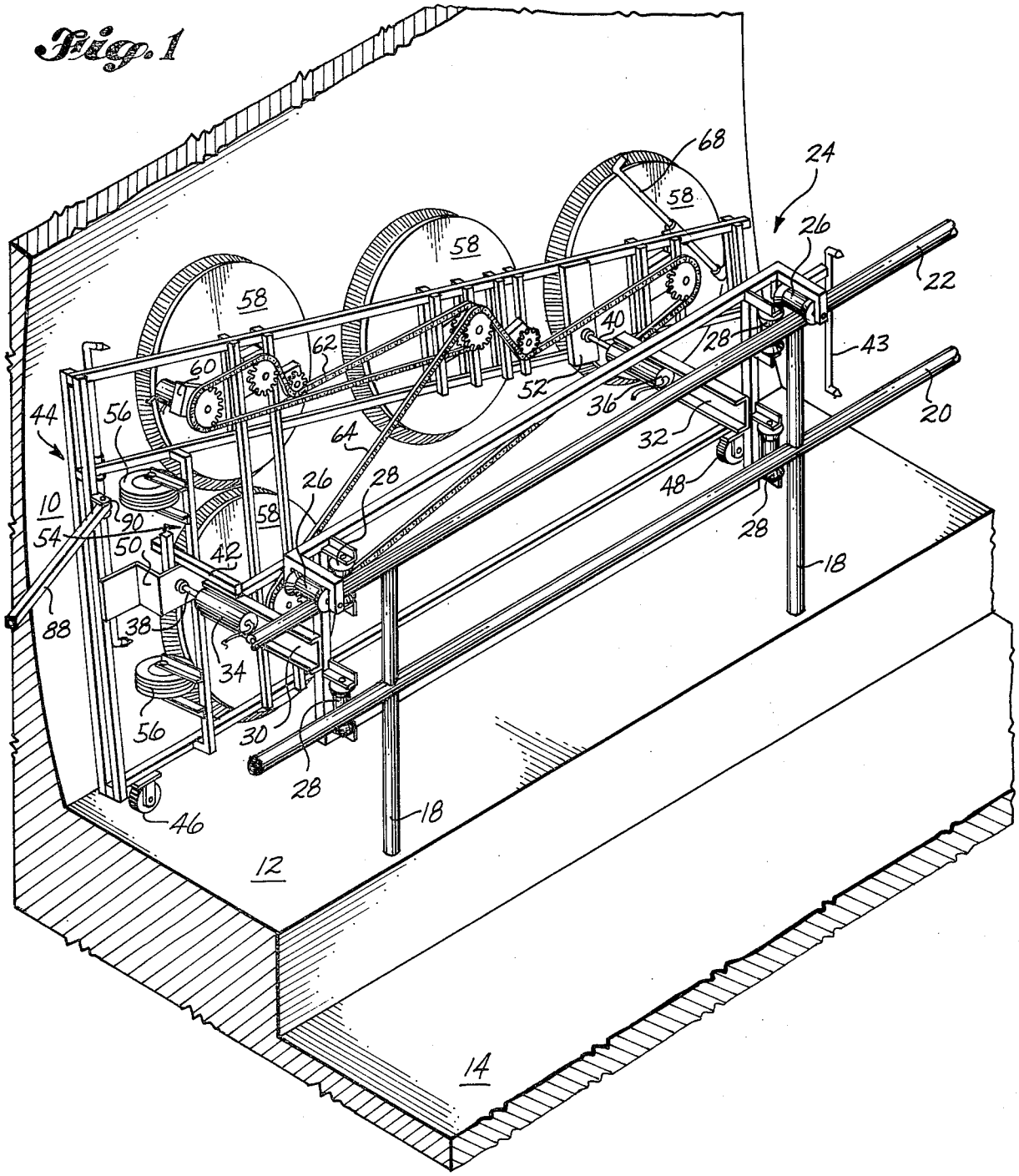
FIG. 1 is an isometric view from an upper aspect of the cleaning apparatus of the present invention, shown in place to clean portions of a tunnel wall behind a walkway railing.

Referring now to FIG. 1, the cleaning apparatus of the present invention is shown in a typical freeway or the like tunnel having a side wall 10, a walkway 12, a roadbed 14, and a railing separating the walkway from the roadbed.

The railing shown includes a plurality of vertical supports 18 and two horizontal bars 20, 22.

The cleaning apparatus shown includes two main assemblies. The first of these is the guidance carriage and assembly which includes a guidance carriage 24 which is adapted to engage the railing 16. Secured to the guidance carriage 24 are two horizontal rollers 26 which engage the top bar 22 of the railing, thereby enabling the railing 16 to provide vertical support for the guidance carriage 24, and enabling the guidance carriage 24 to travel along the railing 16. Four vertically oriented rollers 28, which engage the horizontal bars 20, 22 of the railing, are also fastened to the guidance carriage. The rollers 28 serve to transfer horizontal loading of the guidance carriage 24 to the railing 16 which provides horizontal support for the guidance carriage.

Also mounted on the guidance carriage 24 are a pair of horizontally oriented channel members 30, 32 which extend from the guidance frame 24 toward the side wall 10 of the tunnel. Mounted to the channel members 30, 32 are a pair of penumatic biasing cylinders 34, 36 having a pair of push rods 38, 40. To the top of the front channel member 30 is secured a tow bar 42 for the guidance carriage.

Also mounted to the guidance carriage is a railing spray bar 43 for spraying rinsing solution on the railing.

The second main assembly of the tunnel cleaning apparatus of the present invention is the support carriage assembly which includes a support carriage 44 which rides on front and rear wheels 46, 48. As seen, the front and rear wheels engage the surface of the walkway 12 so that the walkway provides vertical support for the support carriage 44. The support carriage includes a pair of push plates 50, 52 against which the push rods 38, 40 of the pneumatic biasing cylinders are adapted to bear. Above the top of the front push plate 50 is a U-shaped opening 54 which is adapted to receive the tow bar 42 for the guidance carriage.

Secured to the front portion of the support carriage 44 are a pair of obstacle avoidance wheels 56 whose function is described subsequently. Journaled to the support carrier 44 are four flat circular brushes 58, of conventional construction. The four circular brushes are driven through two drive chains 62, 64 by a hydraulic motor 60 which is secured to the support carriage 44.

Figure 2:
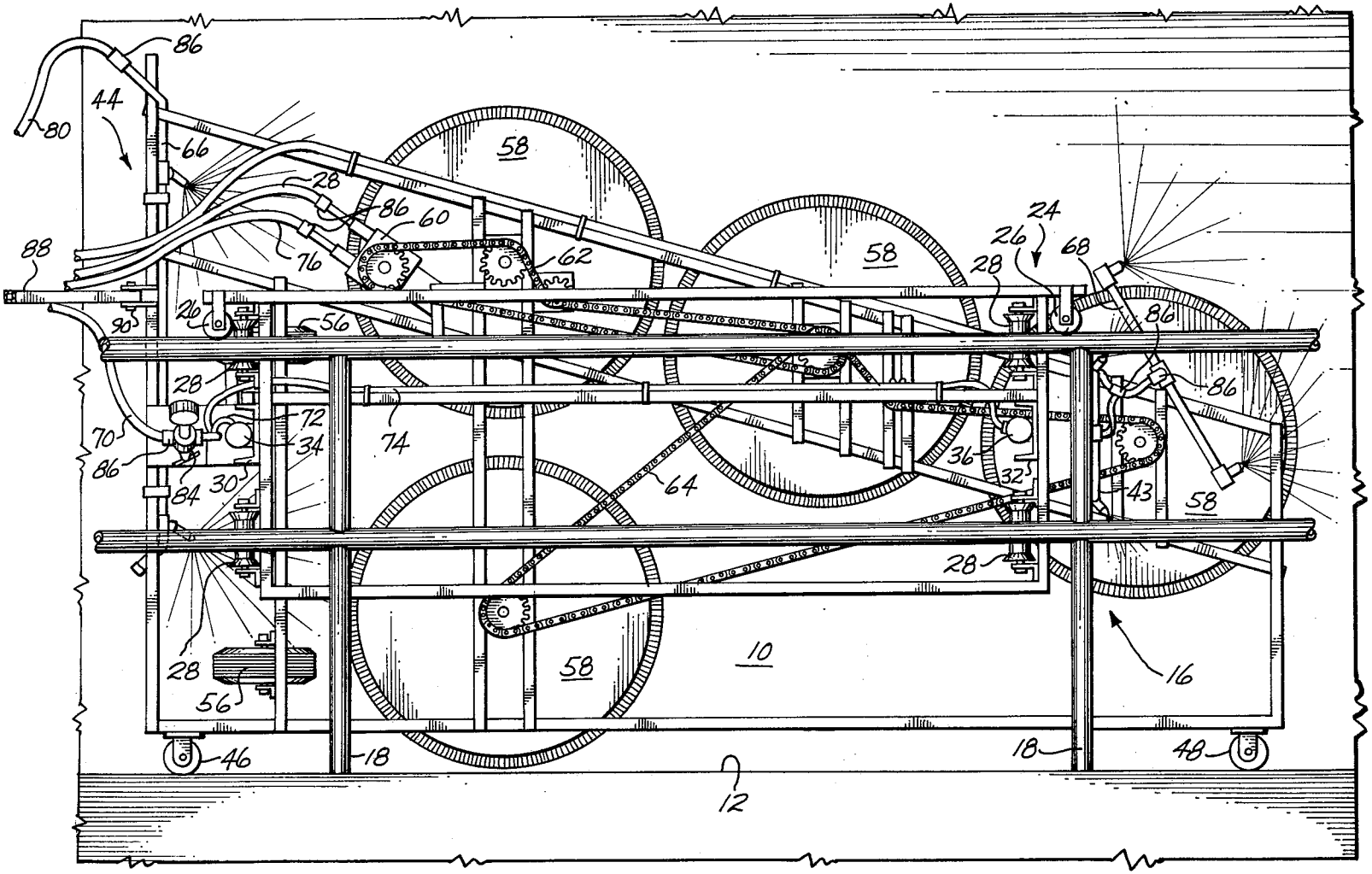
FIG. 2 is a side elevation view of the cleaning apparatus shown in FIG. 1.

Referring now to FIG. 2, it is seen that a cleaning solution dispensing spray bar 66 is secured to the front of the support carriage 44, while a fresh water rinse spray bar 68 is secured to the rear portion of the support carriage. Not shown in FIG. 1 for clarity, but shown in FIG. 2, are the compressed air delivery lines 70, 72, 74 which supply the pneumatic biasing cylinders 34, 36 with compressed air. Also shown in FIG. 2 are the hydraulic supply 76 and return 78 lines for the hydraulic motor 60, the cleaning solution supply line for the front spray bar 66, the rinsing solution delivery line 82 for the rear spray bar 68, and the rinsing solution delivery line 83 for the railing spray bar 43 which is connected to the supply line 82. The compressed air delivery line 70 which supplies compressed air to the regulator 84, the delivery 76 and return 78 lines for the hydraulic motor 60, and the delivery lines 80, 82, 83 for the front and rear spray bars 66, 68, 43, respectively, are all removably connected to their respective components by conventional snap couplings 86.

The compressed air, the hydraulic fluid under pressure, the cleaning solution and the rinsing solution are supplied from a vehicle tracking along the roadbed, inboardly of the walkway, and which tows the support carriage 44 by means of the tow bar 88 which is pivotally connected to the front of the support carriage by a link pin 98.

Figure 3:
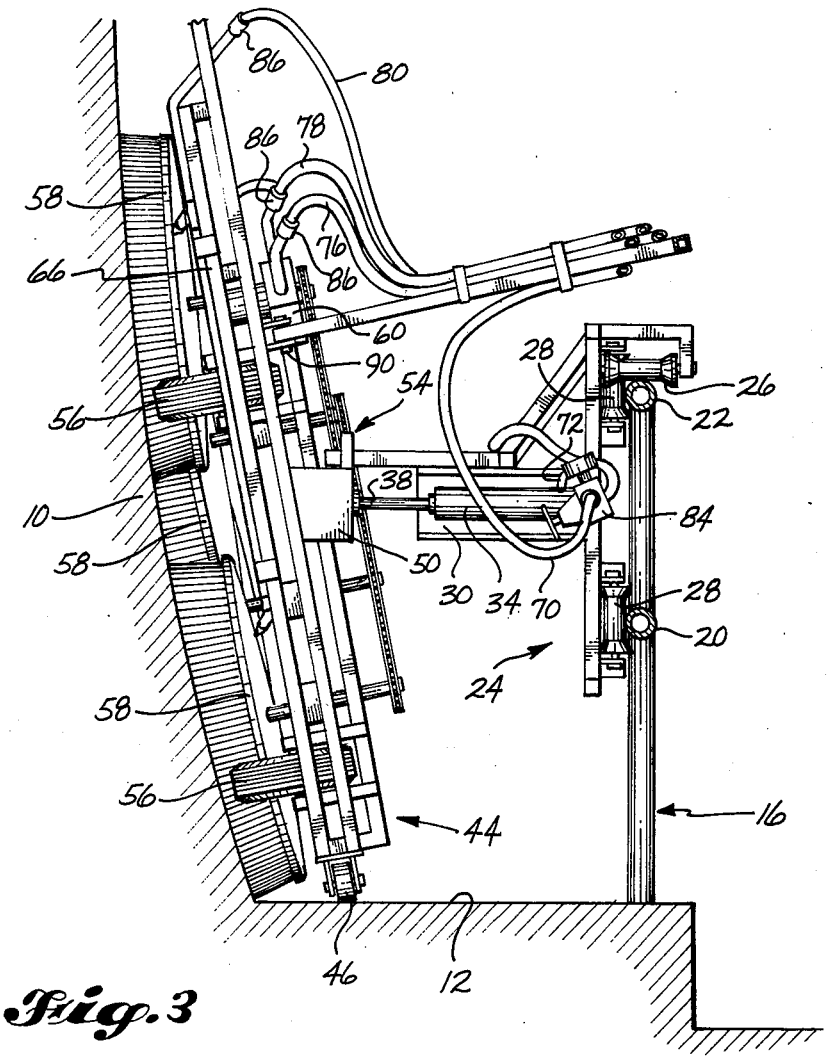
FIG. 3 is a front elevational view of the cleaning apparatus shown in FIG. 2.

It is an important feature of the present invention that it can be used to clean curved tunnel walls, such as that shown in the drawings. However, in order to most effectively employ the circular flat brushes 58 to clean the curved tunnel side wall 10, it is preferable to mount the brushes 58 on the support carriage 44 so that each brush is canted about a generally vertical axis passing through one of its diameters. It will be appreciated that, as seen in FIG. 3 such canting ensures that the leading edges of the flat circular brushes 58 engage the tunnel side wall 10 despite any curvature thereof. Of course, it is to be understood that the brushes could be canted so that their trailing edges, instead of their leading edges engage the curved tunnel wall. Since most tunnels have a substantial diameter, the amount of canting in order to ensure that the brushes engage the curved tunnel side wall 10 most effectively is fairly small. Thus, the cleaning apparatus of the present invention can also be used to clean a vertically planar wall simply by readjustment of the attitude of the brushes.

It is to be also understood that the previously described support carriage assembly and the guidance carriage assembly are basically separate components. Their only interconnections are the tow bar 42 for the guidance carriage 24 and the push rods 38, 40 of the pneumatic biasing cylinders which are adapted to push against the push plates 50, 52 of the support carriage 44. The push rods 38, 40 are not secured to the push plates 50, 52. Thus, as it will be appreciated, the guidance carriage 24 and its associated components are readily removable from the railing 16 and can be taken away while leaving the support carriage 44 and its associated components leaning against the tunnel side wall 10.

The assembly for use and operation of cleaning apparatus according to the present invention is next considered. To place the equipment in operation, the support carriage 44, along with all the components secured thereto, are lifted over the railing 16 and positioned against the tunnel side wall 10, as shown in the drawing. It is notable that the support carriage 44 and its associated components are light enough in weight so that they are emplaceable and removable from behind the railing 16 by two men manipulating such manually, without the necessity of having a crane or other mechanical lifting device present.

With the support carriage in place, the guidance carriage 24 is lifted over and placed upon the railing 16 so that its horizontal and vertical rollers 26, 28 are in engagement with horizontal bars 20, 22 of the railing, as also shown in the drawings. The guidance carriage is light enough so that it also may be positioned on the railing by two men, without need to any mechanical lifting device. As the guidance carriage is lowered into position on the bars 20, 22 of the railing, care is to be taken so that the tow bar 42 for the guidance carriage engages the U-shaped opening 54 in the support carriage. This ensures that the guidance carriage and the support carriage are correctly aligned so that the push rods 38, 40 for the pneumatic biasing cylinders are positioned adjacent the push plates 50, 52 of the support carriage.

Next, the tow bar 88 for the support carriage is pivotally connected to the of carriage by means of a link pin 90 and the ends of the supply and return lines 70, 76, 78, 80 and 82 are connected to their respective components by their snap couplings 86. The other end of the tow bar 88 and the other end of the supply and return lines 70, 76, 78, 80, 82 are connected to a suitable tow vehicle, such as the tunnel cleaning apparatus disclosed in my aforesaid U.S. Pat. No. 3,748,680. Since the tow bar, as well as the vehicle, which includes conventional mechanisms to supply the tunnel cleaning apparatus of the present invention with compressed air, hydraulic fluid under pressure, cleaning solution and rinsing solution, of themselves form no part of the present invention, their construction need not be further described.

After being so assembled and arranged to be towed, the cleaning apparatus of the present invention is now ready for use. The specific sizings of the components hereafter mentioned are by way of non-limiting example only. As hydraulic fluid is supplied through conduit 76 under pressure to the ten horsepower hydraulic motor 60, the circular brushes 58, which are two feet in diameter and have four inch brushes, are driven to rotate counterclockwise at a speed of about 200 rpm. Cleaning solution under pressure is supplied to the front spray bar 66 through the cleaning solution supply line 80, and rinsing solution is supplied to the rear spray bars 68, 83 through the rinsing solution supply line 82, 83. The front, cleaning solution dispensing spray bar 66 is so oriented as to thoroughly wet the wall 10 with the cleaning solution ahead of the circular brushes 58. Similarly, the rear, rinsing solution dispensing spray bar 68 is so oriented as to thoroughly rinse the wall 10 behind the cleaning apparatus of the present invention after the wall has been cleaned by the brushes. The railing spray bar 83 serves to clean the railing.

The support carriage 44 is urged against the wall 10 by the push rods 38, 40 of the one and one-half inch pneumatic biasing cylinders 34, 36 which are supplied with compressed air at about twenty psig through compressed air lines 70, 72, 74. Pneumatic, rather than hydraulic, biasing cylinders are preferred because of the obstacle avoidance wheels 56 at the front of the support carriage 44. If the apparatus of the present invention should encounter an obstacle, such as an electrical conduit or water pipe attached to or standing out from the wall, said wheels 56 enable the front of the apparatus to yieldingly "walk up" and over the obstacle. As the wheels 56 ride up over an obstacle, the support carriage 44 is forced somewhat toward the guidance carriage 24. However, the biasing cylinders 34, 36, since they are pneumatic (and since the contained air is compressible) are able to accommodate this motion, without adjusting the pressure of the compressed air supplied thereto, and the support carriage 44 and brushes 58 are automatically returned to their original positions once the obstacle is passed by.

It should be noted that the wheels 56 also serve to prevent the pneumatic biasing cylinders 34, 36 from urging the support carriage 44, and thus the circular brushes 58, too closely against the wall 10, which might overcompress the bristles and thus lead to early failure of the brushes.

The cleaning apparatus is drawn along the walkway as the towing vehicle courses the roadbed 14, the support carriage 44 being in tow by means of the tow bar 88. The support carriage in turn tows the guidance carriage 24 down the railing 16 by means of the guidance carriage tow bar 42 which is engaged in the previously described U-shaped opening 54 in the support carriage.

It is to be understood that the walkway provides vertical support for the support carriage 44 which rides thereon on its wheels 46, 48, while, the vertical support for the guidance carriage 24 is supplied by the railing 16. It is preferred that the support carriage and the guidance carriage do not carry any of the weight of the other. Horizontal loading of the guidance carriage caused by the action of the pneumatic biasing cylinders 34, 36 is absorbed by the railing 16 which provides horizontal support for the guidance carriage. Of course, the wall 10 provides horizontal support for the support frame 44 and its associated components which are urged thereagainst by the biasing cylinders 34, 36.

As will be apparent, disassembly and removal of the cleaning apparatus from behind the railing occurs in the reverse order of the assembly of the apparatus behind the railing, and need not be further described.

From the foregoing, various further applications, modifications and adaptations of the apparatus disclosed in the invention embodied therein will now be apparent to those skilled in the art to which the invention is addressed, within the scope of the following claims.

I claim:

1. A cleaning apparatus adapted to clean those portions of a tunnel wall or the like which are located behind railing means typically placed along a walkway beside the wall, said apparatus comprising:

guidance carriage means adapted to engage said railing means and to be moved therealong;

support carriage means;

surface cleaning means rotationally secured to said support carriage means;

drive means for rotating said surface cleaning means; and biasing means, connected between said guidance carriage means and said support carriage means, for urging said guidance carriage means and said support carriage means in opposite directions, said support carriage means in turn urging said surface cleaning means into contact with said wall, and said guidance carriage means being urged by said biasing means against said railing means which provides horizontal support for said guidance carriage means.

2. The apparatus according to claim 1, wherein said surface cleaning means comprises a plurality of generally flat, circular brushes.

3. The apparatus according to claim 2, wherein said portions of said wall have a generally curved configuration in vertical cross section and each of said flat circular brushes is canted about a generally vertical axis passing through one of its diameters to ensure contact of the leading edge portions of said brushes with the wall despite the curvature of the wall.

4. The apparatus according to claim 2, wherein said portions of said wall have a generally curved configuration and each of said flat circular brushes is canted about a generally vertical axis passing through one of its diameters to ensure contact of the trailing edge portions of said brushes with the wall despite the curvature which may be present in the wall.

5. The apparatus according to claims 1, 2 or 3 wherein one end of said support carriage includes wheel means adapted to contact said portions of said wall to enable the surface cleaning means to ride over an obstacle on said portions of said wall.

6. The apparatus according to claims 1, 2 or 3 wherein said wall is a tunnel wall and said apparatus is adapted to be towed by a vehicle moving along a roadbed within the tunnel inboardly of said walkway.

7. The apparatus according to claims 1, 2 or 3 wherein:

said guidance carriage means and said support carriage means are removably engageable with each other;

said railing means provides vertical support for said guidance carriage means; and said support carriage means is vertically supported by said walkway.

* * * * *